US005206559A

United States Patent [19]

Fujiwara et al.

[11] Patent Number: 5,206,559

[45] Date of Patent: Apr. 27, 1993

[54] CATHODE RAY TUBE WHICH IMPROVES DEFLECTION ABERRATION

[75] Inventors: Takeshi Fujiwara, Kumagaya; Kiyoshi Tokita; Masatsugu Inoue, both of Fukaya, all of Japan

[73] Assignee: Kabushiki Kaisha Toshiba, Kawasaki, Japan

[21] Appl. No.: 911,788

[22] Filed: Jul. 13, 1992

Related U.S. Application Data

[63] Continuation of Ser. No. 562,607, Aug. 3, 1990, abandoned.

[30] Foreign Application Priority Data

Aug. 4, 1989 [JP] Japan ..... 1-202446
Sep. 29, 1989 [JP] Japan ..... 1-252105

[51] Int. Cl.[5] ..... H01J 29/76

[52] U.S. Cl. ..... 313/440; 313/414; 335/211; 335/213

[58] Field of Search ..... 313/414, 440; 335/211, 335/212, 213, 219; 358/248, 249

[56] References Cited

U.S. PATENT DOCUMENTS

| | | | |
|---|---|---|---|
| 4,197,487 | 4/1980 | Takenaka et al. | 315/370 |
| 4,547,707 | 10/1985 | Yabase | 315/368 |
| 4,659,961 | 4/1987 | Naiki | 313/412 |
| 4,782,264 | 11/1988 | Yamazaki et al. | 313/413 |
| 4,818,919 | 4/1989 | Kobayashi et al. | 315/371 |

FOREIGN PATENT DOCUMENTS

| | | |
|---|---|---|
| 1093625 | 1/1981 | Canada . |
| 51-26208 | 8/1976 | Japan . |
| 53-106626 | 8/1978 | Japan . |
| 54-23208 | 8/1979 | Japan . |
| 57-45748 | 10/1982 | Japan . |
| 58-11707 | 10/1983 | Japan . |
| 60-44351 | 3/1985 | Japan . |
| 60-7796 | 6/1985 | Japan . |
| 62-7849 | 2/1987 | Japan . |
| 60-207035 | 8/1988 | Japan . |

OTHER PUBLICATIONS

Hidenori Takita, "Deflector", Patent Abstracts of Japan, Sep. 5, 1987, vol. 11, No. 275, p. 85 E 537.

Osamu Jonosu, "Deflection Yoke", Patent Abstracts of Japan, Mar. 10, 1988, vol. 12, No. 77 p. 136 E 589.

*Primary Examiner*—Donald J. Yusko
*Assistant Examiner*—N. D. Patel
*Attorney, Agent, or Firm*—Cushman, Darby & Cushman

[57] ABSTRACT

In a cathode ray tube, a first pair of permanent magnet pieces are arranged along a horizontal direction and fixed on an end portion of a deflection unit at an electron gun side in such a manner that poles of one of the magnet pieces face the other poles of the other magnet piece. A second pair of permanent magnet pieces are arranged along a vertical direction, separated from the first pair of permanent magnet pieces by being fixed on a neck portion, forward of the electron gun assembly, and in such a manner that poles of one of the, magnet pieces face the other poles of the other magnet piece.

6 Claims, 12 Drawing Sheets

CATHODE RAY TUBE WHICH IMPROVES DEFLECTION ABERRATION

This is a continuation of application Ser. No. 07/562,607, filed on Aug. 3, 1990, which was abandoned upon the filling hereof.

BACKGROUND OF THE INVENTION

1. Field of the Invention

The present invention relates to a color cathode ray tube which improves deflection aberration i.e., distortion of a beam spot, produced by a deflection magnetic field generated by a deflection unit, thereby improving focusing characteristics, and the deflection unit.

2. Description of the Related Art

In general, as shown in FIG. 1, a color cathode ray tube has an envelope 3 comprising a panel 1 and a funnel 2. A phosphor screen 5 comprising of three color phosphor layers for emitting blue, green, and red light rays is formed on the inner surface of the panel 1, and a shadow mask 4 is arranged to oppose the phosphor screen 5. An electron gun assembly 7 for emitting three electron beams B, G, and R is arranged in a neck 6 of the funnel 2. The three electron beams B, G, and R are horizontally and vertically deflected by a defection unit 9 mounted outside a boundary portion between a conical portion 8 and the neck 6 of the funnel 2, thereby scanning the phosphor screen 5. As a result, a color image is displayed on the phosphor screen 5.

As shown in FIG. 2, the deflection unit 9 has a pair of horizontal deflection coils 10 for horizontally deflecting the three electron beams and a pair of vertical deflection coils 11 for vertically deflecting them.

In order to correctly display an image on the phosphor screen 5 in the color cathode ray tube having the above arrangement, the three electron beams B, G, and R must be correctly converged on all of the phosphor screen 5. For this purpose, a self-convergence in-line type color cathode ray tube is generally adopted. This color cathode ray tube generally uses, as the electron gun assembly 7, an in-line type electron gun assembly emitting three electron beams arranged in line, the center beam G and the pair of side beams B and R emitted from the electron guns passing through the same plane. In the color cathode ray tube provided with this in-line type electron gun assembly, specific non-uniform magnetic fields used as deflection magnetic fields are formed by the defection unit 9, thereby converging the three electron beams B, G, and R on all of the phosphor screen 5. In general, as the un-uniform deflection magnetic field generated in the self-convergence in-line type color cathode ray tube, a pincushion type magnetic field is used as a horizontal deflection magnetic field, and a barrel type deflection magnetic field is used as a vertical magnetic field. By using the above magnetic fields, the three electron beams B, G, and R arranged in line passing through the same horizontal plane ca be converged at one point on the phosphor screen 5.

When the magnetic field is generated in this manner in the in-line type color cathode ray tube, coma aberration, in which convergence between the center beam G and the side beams B and R is shifted in a peripheral portion of the screen, may be produced.

In order to correct this coma aberration, in techniques disclosed in Published Examined Japanese Patent Application Nos. 51-26208 and 54-23208, a magnetic member to be coupled to a magnetic field leaking from a rear side of a deflection unit is arranged in an electron gun assembly. In addition, in a technique disclosed in Published Examined Utility Model No. 57-45748, an auxiliary coil is arranged at the electron gun assembly side of the deflection unit and a current in synchronism with a deflection current flowing through a vertical deflection coil is supplied to the auxiliary coil. This generates an intense pin-cushion type magnetic field without using a magnetic member to be coupled to a magnetic field leaking from a rear portion of the deflection unit.

In these conventional color cathode ray tubes, however, a spot of an electron beam on the phosphor screen is still distorted in accordance with deflection. That is, as shown in FIG. 3, a spot 13 of an electron beam deflected by an uniform magnetic field is formed into a substantially true circle on the entire surface of a screen 14. As shown in FIG. 4, however, a spot 13 of an electron beam deflected by a non-uniform magnetic field is distorted into a lateral ellipse having the horizontal direction as its major axis at the end of the horizontal axis (X axis) of the screen 14. That is, as shown in FIG. 5A, the electron beams B, G, and R are distorted by a pin-cushion type horizontal deflection magnetic field 15 such that an upper half of each beam is pushed downward and its lower half is pushed upward by a Lorentz force. At the end of the vertical axis (Y axis) on the screen 14, as shown in FIG. 5B, each of the electron beams B, G, and R is distorted into a lateral ellipse having the horizontal direction as its major axis by a barrel type vertical deflection magnetic field 16 such that a right half of each electron beam is pushed to the right and its left half is pushed to the left by a Lorentz force. The magnitudes of forces applied to the right and left sides of each of the pair of side beams B and R are different from each other, and the direction of a force applied to the electron beam B at the left side of the screen is opposite to that of a force applied to the electron beam R at the right side thereof. Therefore, spots of the side beams B and R at the end of the vertical axis are inclined to cross each other as indicated by reference numerals 13B and 13R in FIG. 4. As a result, focusing characteristics at the peripheral portion of the screen 14 are significantly degraded by deformation or inclination of the beam spots caused by the horizontal or vertical deflection magnetic field 15 or 16. In addition, this degradation in focusing characteristics does not allow high performance of the electron gun assembly.

For this reason, in order to improve the focusing characteristics at the peripheral portion of the screen 14, compromising design must be made in consideration of uniformity of focusing at the central and peripheral portions of the screen 14 at the sacrifice of focusing at the central portion of the screen 14.

Since the auxiliary coil used in Published Examined Utility Model Application No. 57-45748 uses a current synchronized with a deflection current flowing through the vertical deflection coil, the following problem is posed. That is, when an electron beam is to be deflected in the vertical direction, the electron beam is excessively deflected in the vertical direction at the electron gun assembly side of the deflection unit by a magnetic field generated in the horizontal direction on the horizontal axis, and tends to collide against the inner wall of the neck of the funnel. As a result, a portion called a neck shadow which does not emit light rays, because no electron beam reaches there, tends to be formed on the screen. In addition, this auxiliary coil is manufactured by winding a coil around a magnetic member, and a current is flowed through the coil. Therefore, this auxiliary coil is expensive as a correction element, and it is difficult to decrease its manufacturing cost. Furthermore, the deflection unit is often used by changing its impedance in accordance with the type of a receiver of each set maker, and a current to be flowed through the deflection coil is changed in accordance with the changed impedance. Therefore, in order to allow the auxiliary coil to properly operate with respect to the deflection unit, the specification of the auxiliary coil must be changed in accordance with the impedance of the deflection coil, resulting in poor mass-productivity.

SUMMARY OF THE INVENTION

It is an object of the present invention to provide a color cathode ray tube which reduces distortion of a spot of an electron beam caused by a deflection magnetic field of a deflection unit, i.e., deflection aberration. This reduction of distortion prevents degradation in focusing characteristics at the peripheral portion of a screen, thereby obtaining good focusing characteristics on the whole areas of the screen, and the deflection unit.

According to the invention, there is provided a cathode ray tube apparatus, comprising: an envelope having a tube axis; an in-line type electron gun assembly, received in the envelope, for emitting a center electron beam and two side beams in the same plane; and a deflection magnetic field generating means for generating a mainly pin-cushion type deflection magnetic field for deflecting the electron beams in a first direction along the plane and generating a mainly barrel type deflection magnetic field for deflecting the electron beams in a second direction perpendicular to the first direction. The cathode ray tube apparatus further comprises a first pair of permanent magnet pieces, each having one and opposite poles. The first pair of permanent magnets are located between the deflection magnetic field generating means and the electron gun assembly and are closer to the deflection magnetic field generating means. These magnets are arranged in the first direction so as to be substantially symmetrical about the tube axis, and faced to each other in such a manner that different polarities are opposed to each other, for constantly generating a pin-cushion type first correction magnetic field. The cathode ray tube apparatus further comprises a second pair of permanent magnet pieces, each having one and opposite poles. The second pair of permanent magnets are located between the deflection magnetic field generating means and the electron gun assembly so as to be separated from the first pair of permanent magnet pieces at the side of the electron gun assembly. These magnets are arranged in the second direction so as to be substantially symmetrical about the tube axis, and faced to each other in such a manner that different polarities are opposed each other, for constantly generating a pin-cushion type second correction magnetic field.

According to the invention, there is also provided a cathode ray tube apparatus comprising: an envelope having a tube axis; an in-line type electron gun assembly, received in the envelope, for emitting a center electron beam and two side beams in the same plane; and a deflection magnetic field generating means for generating a mainly pin-cushion type deflection magnetic field for deflecting the electron beams in a first direction along the plane and generating a mainly barrel type deflection magnetic field for deflecting the electron beams in a second direction perpendicular to the first direction. The cathode ray tube apparatus further comprises a first arrangement of two pairs of permanent magnet pieces, each having one and opposite poles. This first arrangement of two pairs of magnets are located between the deflection magnetic field generating means and the electron gun assembly and closer to the deflection magnetic field generating means. These magnets are arranged in the first direction so as to be substantially symmetrical about the tube axis, each pair being faced to each other in such a manner that different polarities are opposed to each other, for constantly generating a pin-cushion type first correction magnetic field. The cathode ray tube apparatus further comprises a third pair of permanent magnet pieces, having one and opposite poles. This third pair of permanent magnets are located between the deflection magnetic field generating means and the electron gun assembly so as to be separated from the first pair of permanent magnet pieces at the side of the electron gun assembly. These magnets are arranged in one of the first and second directions so as to be substantially symmetrical about the tube axis, and faced to each other in such a manner that different polarities are opposed to a facing first pair of magnet, for constantly generating a pin-cushion type second correction magnetic field.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of a color cathode ray tube apparatus according to the present invention will be described in detail below with reference to the accompanying drawings.

Embodiment 1

Figure 1:
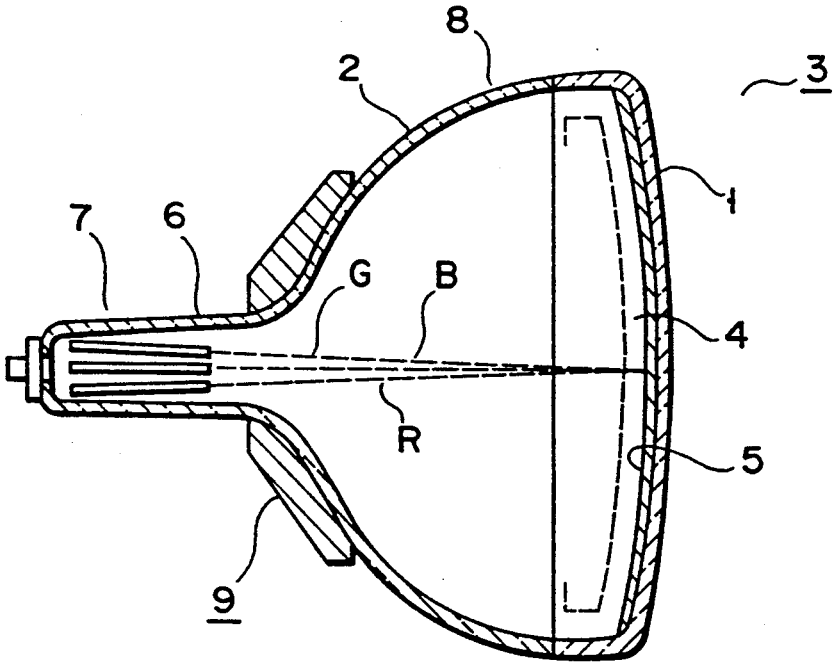
FIG. 1 (PRIOR ART)
FIG. 1 is a schematic sectional view showing a conventional color cathode ray tube.
Figure 2:
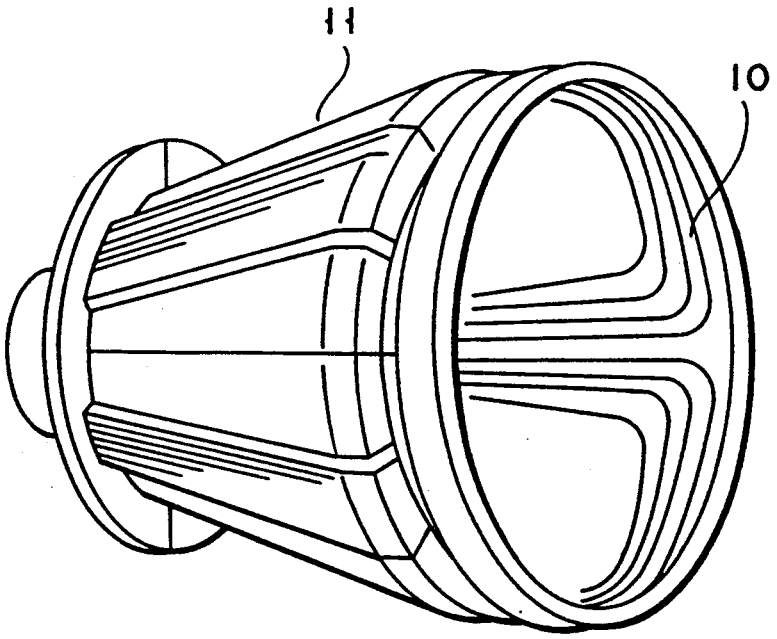
FIG. 2 (PRIOR ART)
FIG. 2 is a schematic perspective view showing a deflection unit to be mounted on the color cathode ray tube shown in FIG. 1.
Figure 3:
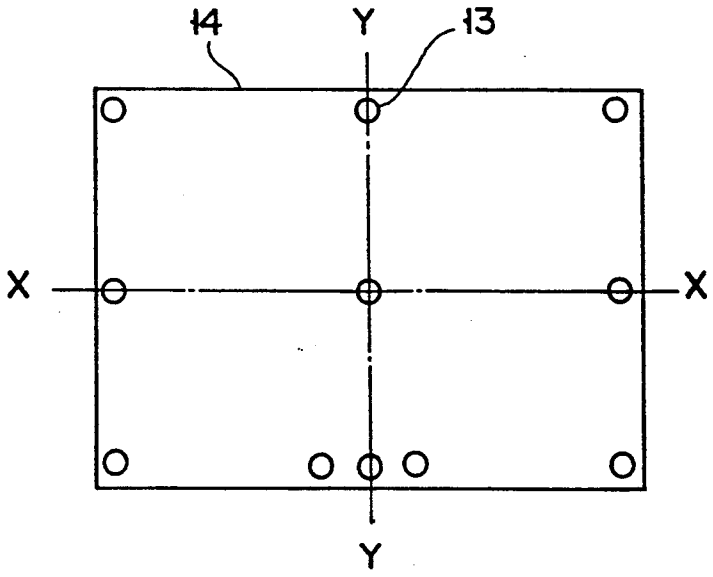
FIG. 3 (PRIOR ART)
FIG. 3 is a plan view for explaining the shape of spots on a screen produced by electron beams deflected by a deflection unit for generating uniform magnetic fields.
Figure 4:
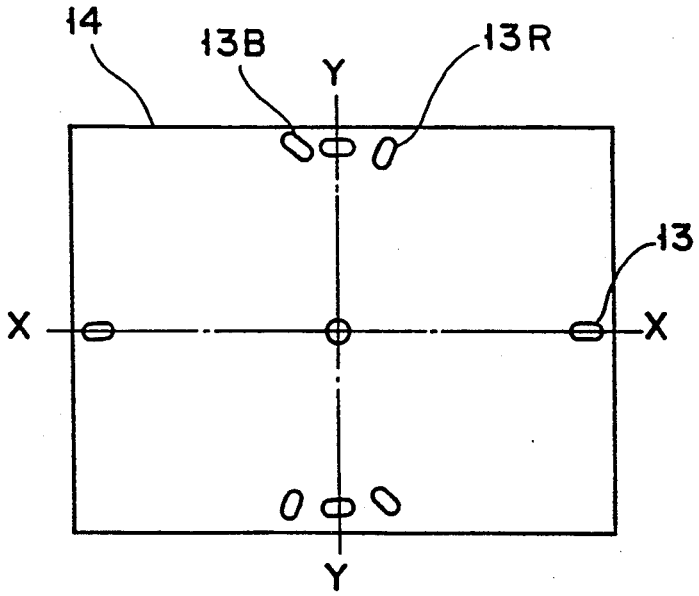
FIG. 4 (PRIOR ART)
FIG. 4 is a plan view for explaining the shape of spots on a screen produced by electron beams deflected by a deflection unit for generating a non-uniform magnetic fields.
Figure 5A:
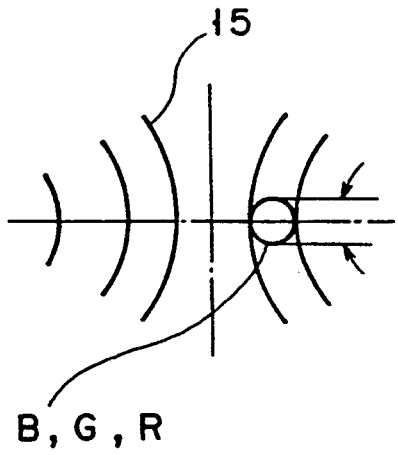
FIG. 5A (PRIOR ART)
FIGS. 5A and 5B are views for explaining effects of a pin-cushion type horizontal deflection magnetic field and a barrel type vertical deflection magnetic field on electron beams.
Figure 5B:
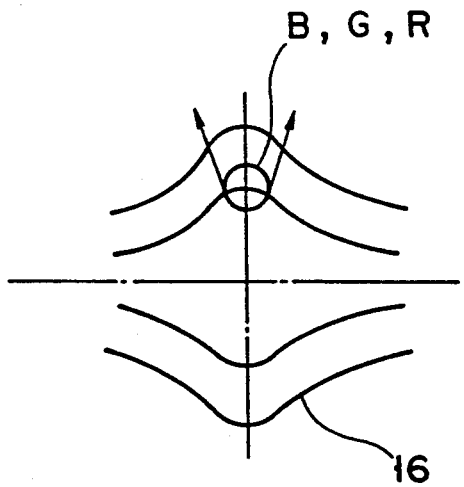
FIG. 5B (PRIOR ART)
Figure 6:
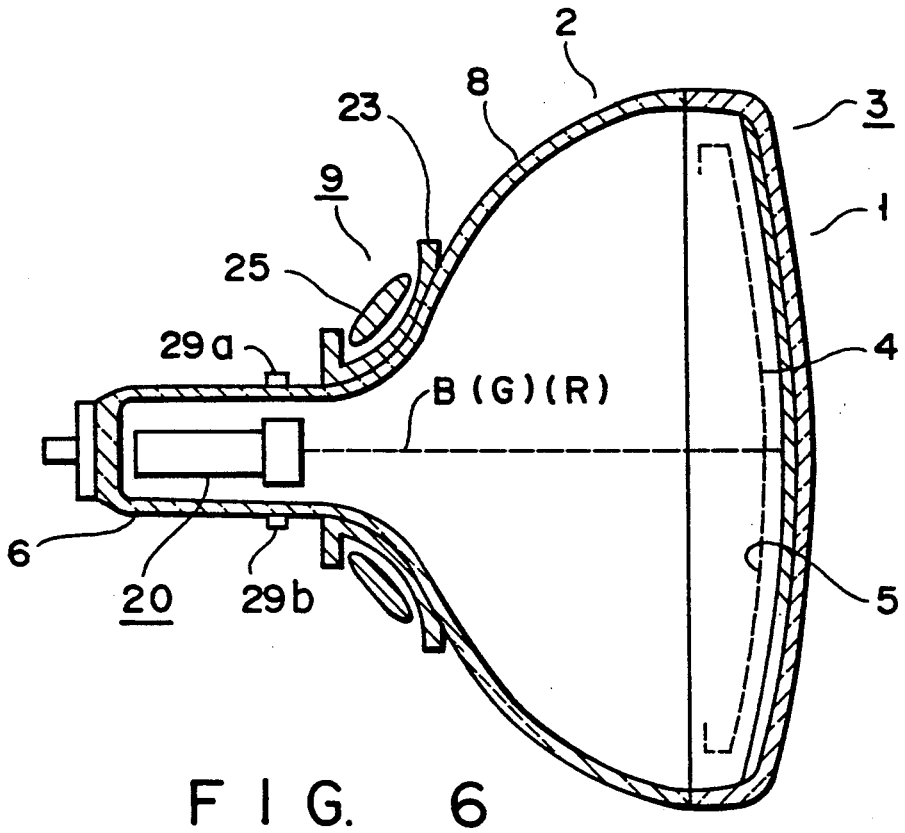
FIG. 6 is a schematic sectional view showing a color cathode ray tube according to the first embodiment of the present invention.

FIG. 6 shows an embodiment of a color cathode ray tube of self-convergence in-line type. This color cathode ray tube has an envelope 3 constituted by a panel 1 and a funnel 2. A phosphor screen 5 consisting of three color phosphor layers for emitting blue, green, and red light rays is formed on the inner surface of the panel 1 to oppose a shadow mask 4 mounted inside the panel 1 and having a large number of electron beam apertures. An in-line type electron gun assembly 20 (to be described later) for emitting three electron beams B, G, and R aligned in a line passing through the same horizontal plane is arranged in a neck 6 of the funnel 2. In addition, a deflection unit 9 is mounted outside a boundary portion between a conical portion 8 and the neck 6 of the funnel 2 to vertically and horizontally deflect the three electron beams B, G, and R emitted from the electron gun assembly 20, thereby scanning the phosphor screen 5.

Figure 7:
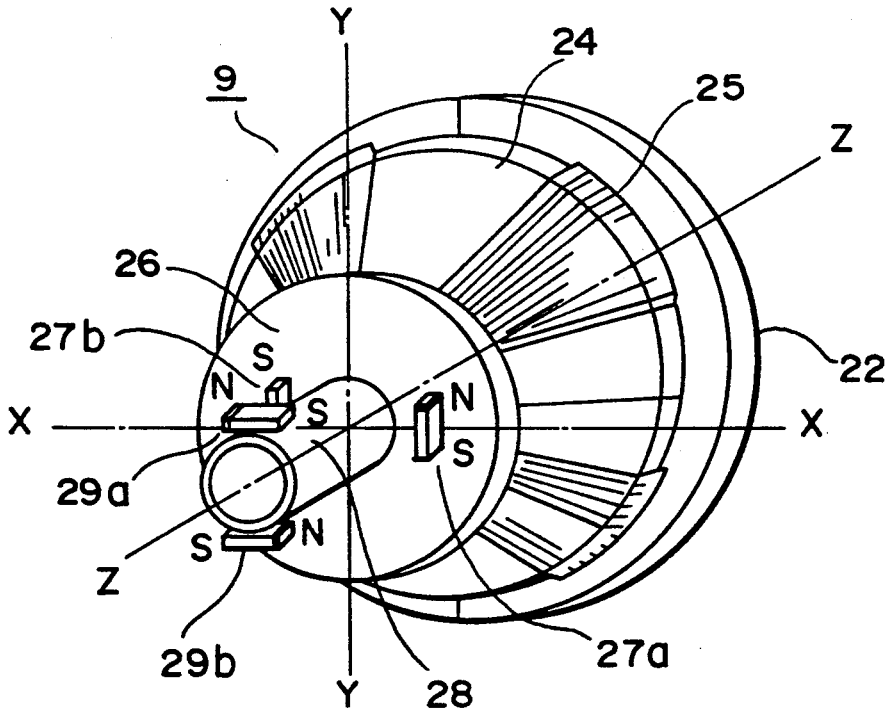
FIG. 7 is a perspective view showing a deflection unit to be mounted on the color cathode ray tube shown in FIG. 6 and two pairs of permanent magnets mounted on the deflection unit.

The deflection unit 9 is of self-convergence type of converging the three electron beams B, G, and R on the phosphor screen 5 by using an inhomogeneous magnetic field. As shown in FIG. 7, for example, the deflection unit 9 has a pair of horizontal deflection coils 23 wound to form a saddle shape and arranged inside a separator 22, and a pair of vertical deflection coils 25 wound around a core 24 and arranged outside the separator 22. The horizontal deflection coils 23 of the deflection unit 9 form a mainly pin-cushion type deflection magnetic field for deflecting the three electron beams emitted from the electron gun assembly 20 in the horizontal direction, i.e., in the X direction, and the vertical deflection coils 25 form a mainly barrel type deflection magnetic field for deflecting the three electron beams in the vertical direction perpendicular to the beam aligning direction, i.e., in the Y direction. In this case, the "mainly pin-cushion type deflection magnetic field" means a pin-cushion type deflection magnetic field as a whole, and the "mainly barrel type deflection magnetic field" means a barrel type deflection magnetic field as a whole.

As shown in FIG. 7, in this color cathode ray tube, the pair of permanent magnets 27*a* and 27*b* are arranged on an end portion 26 at the electron gun assembly side of the deflection unit 9 in the left-to-right direction, i.e., the horizontal direction, so as to be symmetrical about a tube axis Z with different polarities being opposed each other. In addition, the pair of permanent magnets 29*a* and 29*b* are arranged at a position 28 separated from the permanent magnets 27*a* and 27*b* toward the electron gun assembly with a predetermined interval therebetween in the upper-to-lower direction, i.e., the vertical direction, so as to be symmetrical about the tube axis Z with different polarities being opposed each other.

Figure 8:
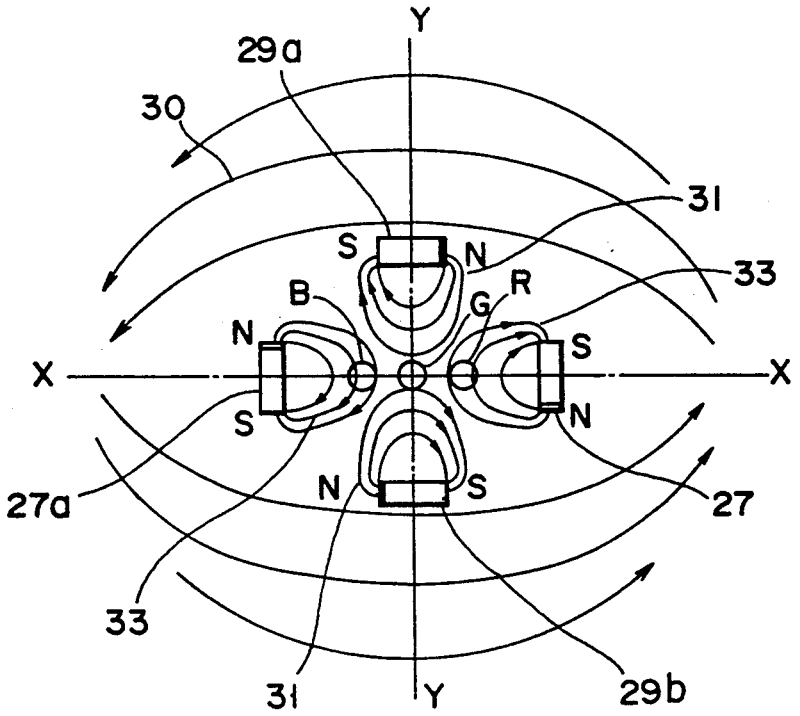
FIG. 8 is a view for explaining a pin-cushion type magnetic field generated by the two pairs of permanent magnets shown in FIG. 7.

As shown in FIG. 8, the vertically arranged permanent magnets 29*a* and 29*b* generate an intense pin-cushion magnetic field 31 on an electron beam path between the electron gun assembly 20 and the deflection unit 9 in correspondence with a barrel type deflection magnetic field 30 generated by the vertical deflection coils, thereby producing a Lorentz force. This Lorentz force applied in a direction opposite to that of a Lorentz force applied from the barrel type vertical deflection magnetic field on electron beams, for distorting the electron beam spot into an ellipse having the vertical direction as its major axis, and correcting a phenomenon in which spots of the pair of side beams are inclined.

Figure 9:
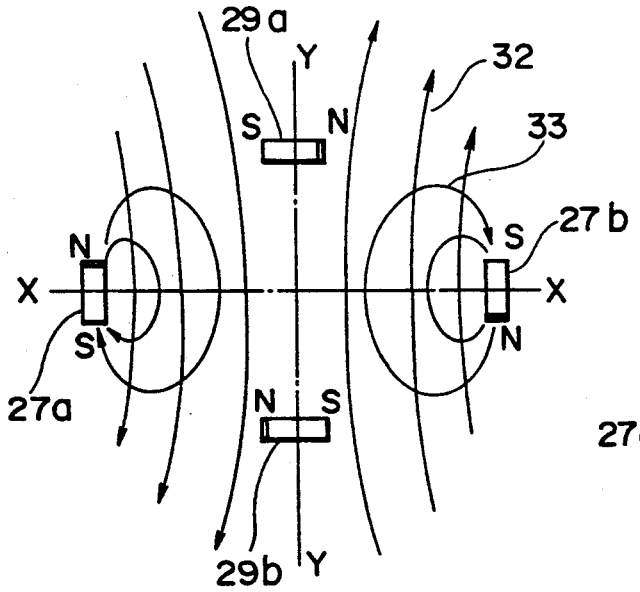
FIG. 9 is a view for explaining a pin-cushion type magnetic field generated by the pair of right and left permanent magnets shown in FIG. 7.

As shown in FIG. 9, the permanent magnets 27*a* and 27*b* arranged in the left-to-right direction so as to be separated from the upper and lower permanent magnets 29*a* and 29*b* toward the phosphor screen with a predetermined interval therebetween generate a pin-cushion type magnetic field 33 in the same direction as that of the pin-cushion type magnetic field 32 on the electron beam path between the electron gun assembly 20 and the deflection unit 9.

Figure 10:
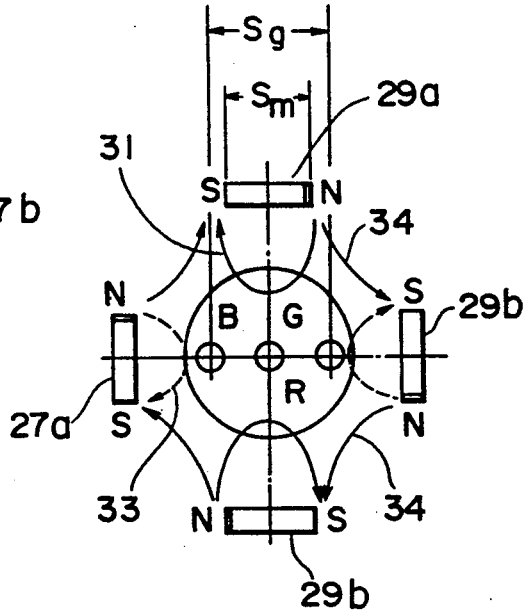
FIG. 10 is a view for explaining a pin-cushion type magnetic field generated by the two pairs of upper and lower, and right and left permanent magnets shown in FIG. 7.

The upper, lower, left, and right permanent magnets 29*a*, 29*b*, 27*a*, and 27*b* are arranged such that different polarities are opposed each other. Therefore, as shown in FIG. 10, the permanent magnets 27*a* and 27*b* generate magnetic fields 34 between the adjacent permanent magnets 29*a* and 29*b*, respectively in a space in the tube axis direction. These magnetic fields 34 apply a Lorentz force on the side beams B and R in a direction opposite to the direction along which spots of the side beams are inclined by the barrel type vertical deflection magnetic field, thereby correcting the inclination of the spots of the side beams B and R at the phosphor screen vertical end portion caused by the barrel type deflection magnetic field.

U.S. Ser. No. 371,844, filed Jun. 27, 1989, Takeshi Fujiwara et al. discloses a technique in which the upper, lower, left, and right permanent magnets 29*a*, 29*b*, 27*a*, and 27*b* are arranged on the same plane. A difference between an arrangement in which the permanent magnets 29*a*, 29*b*, 27*a*, and 27*b* are arranged on the same plane and an arrangement in which the upper and lower permanent magnets 29*a* and 29*b* and the left and right permanent magnets 27*a* and 27*b* are not arranged on the same plane but separated from each other will be described below.

Figure 11:
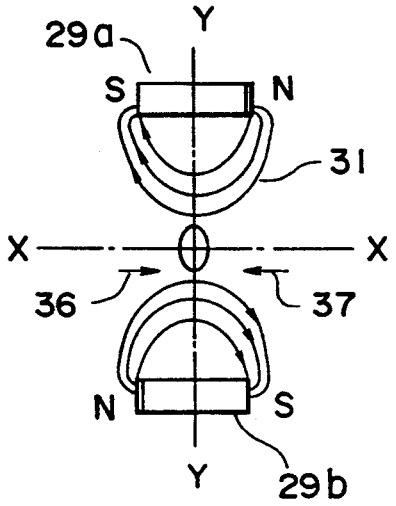
FIG. 11 is a view for explaining an effect of a pin-cushion type magnetic field generated by the pair of upper and lower permanent magnets shown in FIG. 7 on electron beam spots.
Figure 12:
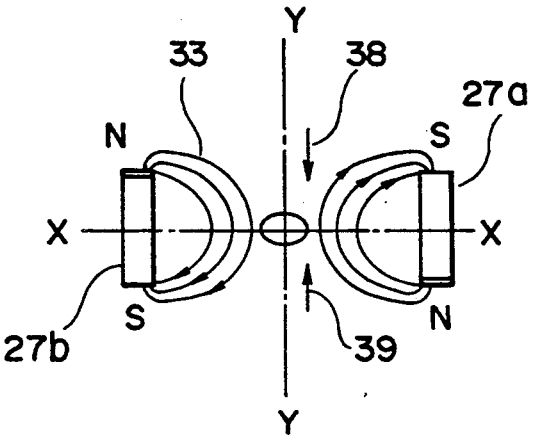
FIG. 12 is a view for explaining an effect of the pin-cushion type magnetic field generated by the pair of right and left permanent magnets shown in FIG. 7 on electron beam spots.
Figure 13:
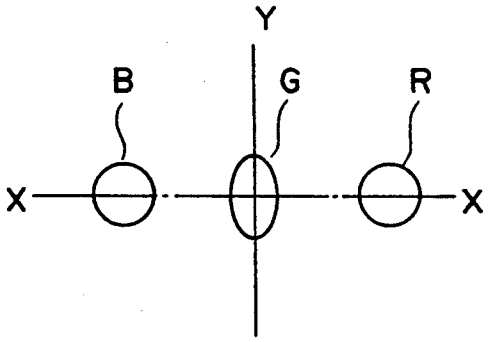
FIG. 13 is a view showing shapes of electron beam spots for explaining the effect when two pairs of the permanent magnets arranged in a same plane.

An effect of the pin-cushion magnetic fields 31 and 33, generated by the permanent magnets 29*a* and 29*b* and the permanent magnets 27*a* and 27*b*, respectively, as shown in FIG. 8 when all the magnets 29*a*, 29*b*, 27*a*, and 27*b* are arranged on the same plane, is degraded focusing quality. As shown in FIG. 11, the pin-cushion type magnetic field 31 generated by the upper and lower permanent magnets 29*a* and 29*b* applies, to the electron beams, Lorentz forces 36 and 37 for distorting the beam spot into an ellipse having its major axis in the vertical direction as described above. As shown in FIG. 12, however, the pin-cushion type magnetic field 33 generated by the left and right permanent magnets 27*a* and 27*b* applies, to the electron beams, Lorentz forces 38 and 39 for distorting a beam spot into an ellipse having its major axis in the horizontal direction. Therefore, by properly setting the magnetization intensities of the magnets 29*a* and 29*b* and the magnets 27*a* and 27*b*, a beam spot of each of the three electron beams at the central portion of the phosphor screen can be formed substantially circle. However, in the in-line type electron gun assembly in which a center beam and a pair of side beams are aligned in a line on the same plane as shown in FIG. 8, although the center beam is located at the tube axis center, the centers of the side beams are separated from the tube axis center. Therefore, the magnitudes of Lorentz forces applied by the two pin-cushion type magnetic fields 31 and 33 are different between the center beam and the side beams. As a result, as shown in FIG. 13, when the magnetization intensities of the magnets 29*a*, 29*b*, 27*a*, and 27*b* are set such that the side beam spots are formed into true circles, a beam spot of the center beam is distorted into an ellipse having its major axis in the vertical direction on the screen. This difference between the spot shapes of the center beam and the side beams based on the longitudinal elliptic shape of the center beam spot, i.e., between ellipticities, causes degradation in resolution at the central portion of the phosphor screen thereby undesirably degrading focusing quality of the color cathode ray tube.

Figure 14:
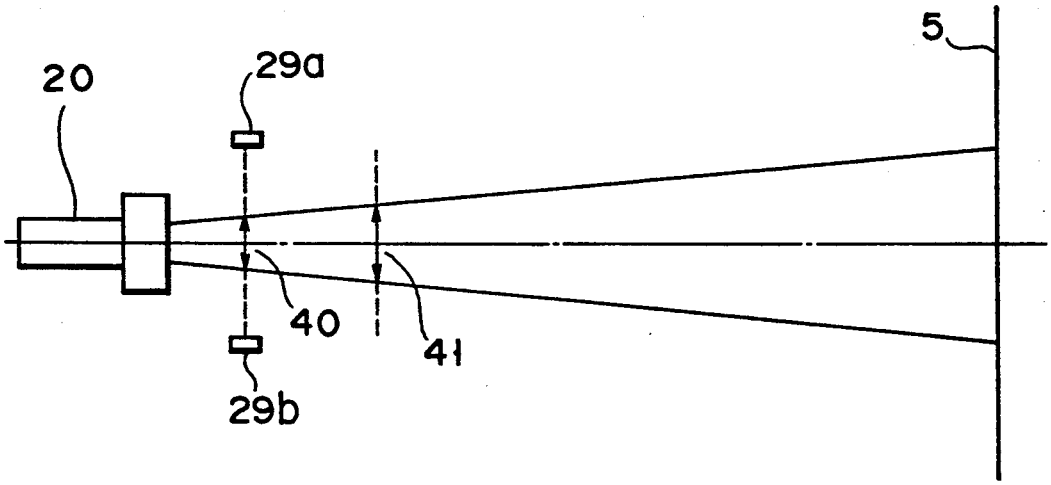
FIG. 14 is a view for explaining a positional relationship between an electron beam diameter and a pair of upper and lower permanent magnets.
Figure 15:
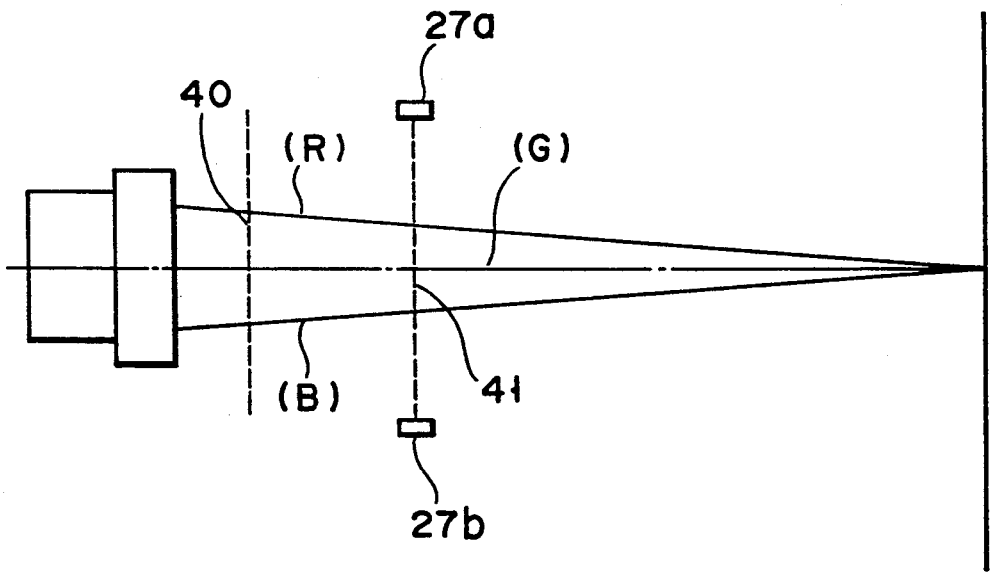
FIG. 15 is a view for explaining a positional relationship between a pair of side beams and a pair of right and left permanent magnets.

If, however, the upper and lower permanent magnets 29*a* and 29*b* are arranged at a position separated from the left and right permanent magnets 27*a* and 27*b* with a predetermined interval therebetween as shown in FIG. 7, differently between the ellipticities or the center beam G and the side beams B and R can be corrected. That is, as shown in FIG. 14, each electron beam is emitted from the electron gun assembly 20 and incident on the central portion of the phosphor screen while it is slightly diverged on the vertical plane. Therefore, since an electron beam diameter is small in an area 40 affected by the pin-cushion type magnetic field generated by the permanent magnets 29*a* and 29*b*, a Lorentz force applied by the pin-cushion magnetic field to the electron beams is weaker than that applied to the electron beams when the magnets 29*a* and 29*b* are arranged in an area 41. As a result, a beam spot of the center beam G can be prevented from being distorted into a longitudinal ellipse having its major axis in the vertical direction. In addition, as shown in FIG. 15, the pair of side beams B and R are emitted obliquely from the electron gun assembly 20 so as to be converged at one point at the center of the phosphor screen 5. Therefore, in the area 41 in which the pin-cushion type magnetic field generated by the permanent magnets 27*a* and 27*b* has an effect on the side beams B and R, the side beams are moved closer to the center beam G, i.e., the tube axis Z than in the area 40. When the magnets 27*a* and 27*b* are arranged in the area 41, since a Lorentz force applied by the pin-cushion magnetic field generated by the magnets 27*a* and 27*b* is weaker than that obtained when the magnets 27*a* and 27*b* are arranged in the area 40, the side beams B and R pass through an area having a weak Lorentz force. As a result, the electron beam spots of the side beams can be prevented from being distorted into a lateral ellipse having its major axis in the horizontal direction.

Figure 16:
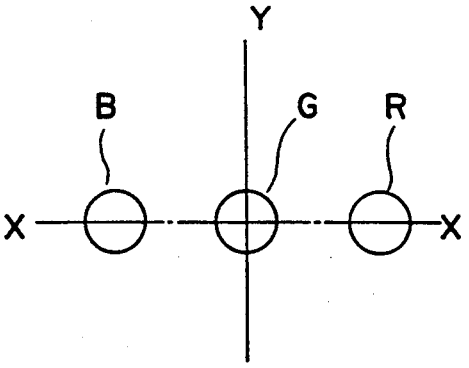
FIG. 16 is a view showing shapes of electron beam spots for explaining electron beam spots obtained by an effect of the pin-cushion type magnetic field generated by the two pairs of permanent magnets according to the present invention.

Therefore, by properly setting the magnetization intensities of the pair of upper and lower permanent magnets and the pair of left and right permanent magnets 27*a* and 27*b* in accordance with an interval in the tube axis direction between the two pairs of magnets, a beam spot of each of the three electron beams at the central portion of the phosphor screen can be corrected into a substantially true circle as shown in FIG. 16.

Embodiment 2

Figure 17:
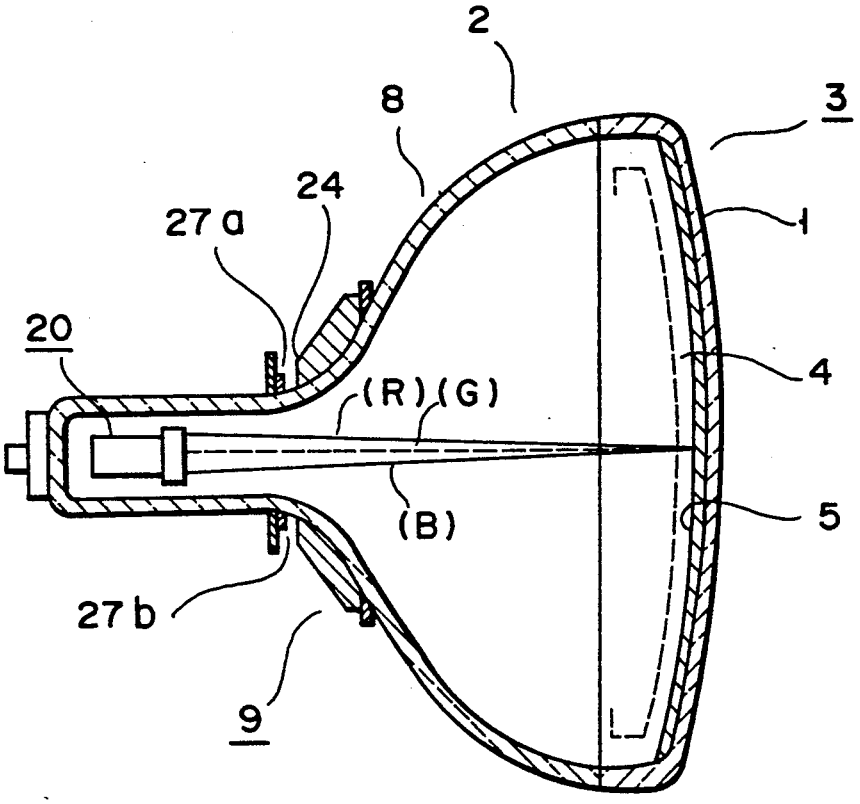
FIG. 17 is a schematic sectional view showing a color cathode ray tube according to the second embodiment of the present invention.

In Embodiment 1, the pair of left and right permanent magnets 27*a* and 27*b* are arranged at the end portion of the electron gun assembly side of the deflection unit 9. However, the present invention is not limited to the above embodiment. For example, as shown in FIG. 17, a pair of permanent magnets 27*a* and 27*b* may be arranged near a core 24 of a deflection unit 9. In this case, pairs of permanent magnets 29*a* and 29*b*, and 27*a* and 27*b* can be arranged in an area in which an electron beam is diverged to increase its beam diameter, i.e., can be arranged closer to a phosphor screen. Therefore, an effect of correcting distortion of a beam spot at the vertical end portion of the phosphor screen can be desirably enhanced.

Embodiment 3

Figure 18:
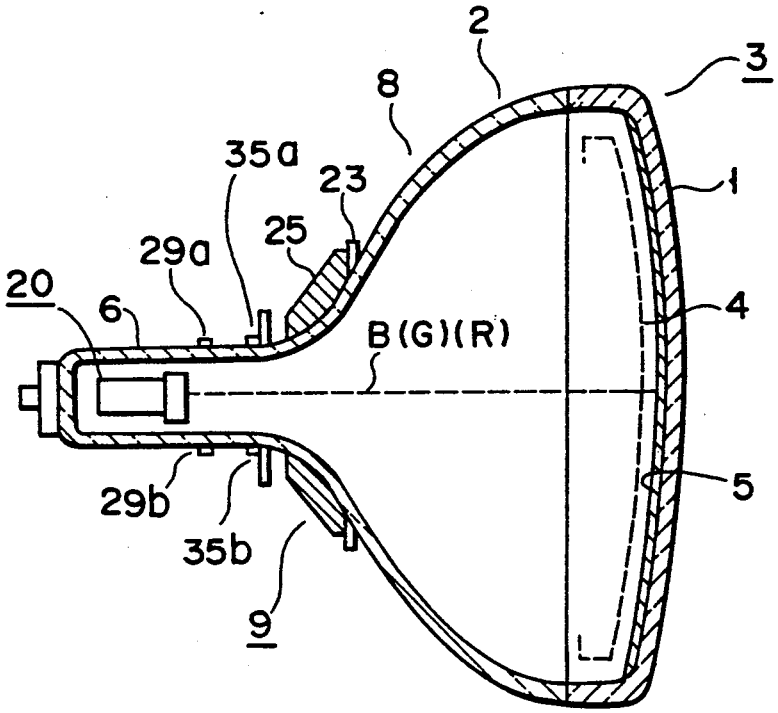
FIG. 18 is a schematic sectional view showing a color cathode ray tube according to the third embodiment of the present invention.
Figure 19:
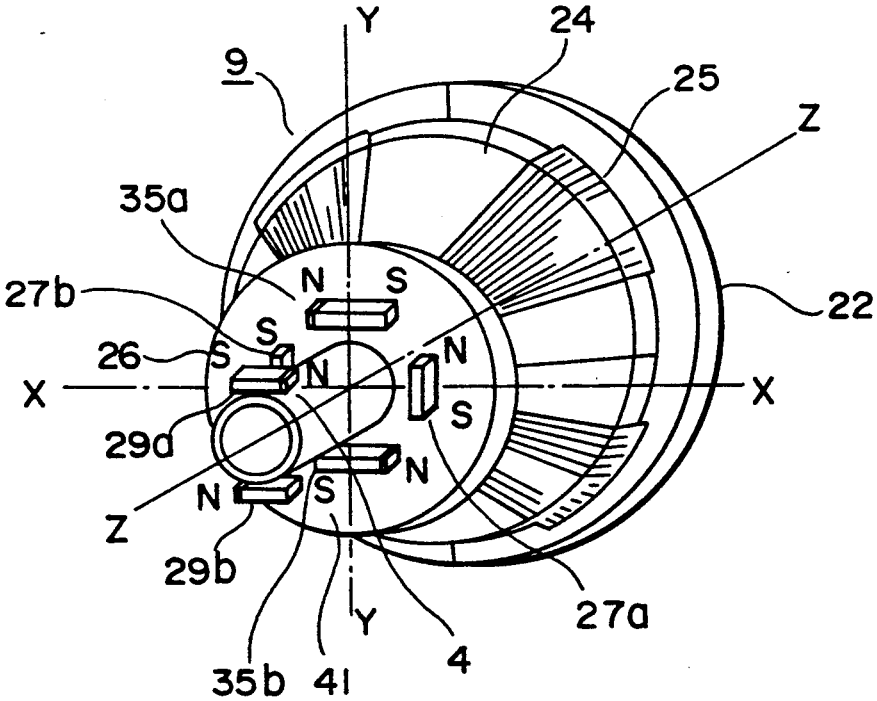
FIG. 19 is a perspective view showing a deflection unit to be mounted on the color cathode ray tube shown in FIG. 18 and three pairs of permanent magnets mounted on the deflection unit.
Figure 20:
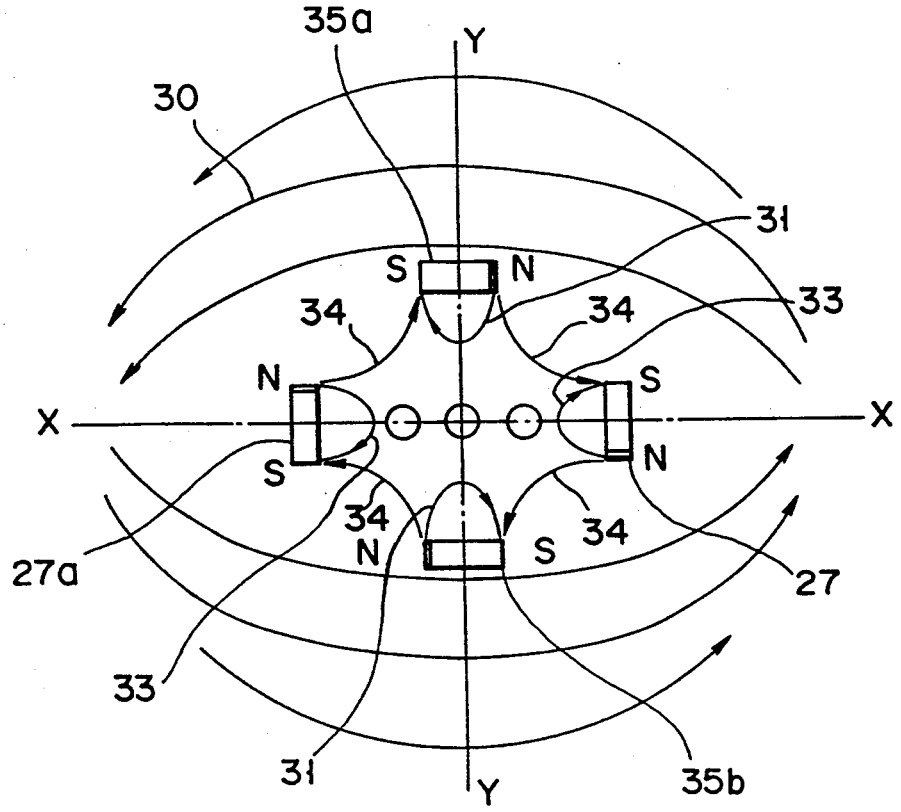
FIGS. 20 and 21 are views for explaining an effect of a pin-cushion type magnetic field generated by the first two pairs of permanent magnets shown in FIG. 18 on electron beam spots.

As shown in FIGS. 18 and 19, permanent magnets 35*a* and 35*b* may be arranged in addition to permanent magnets 27*a* and 27*b* at a side end portion 26 of an electron gun assembly of a deflection unit 9. That is, two pairs of permanent magnets 35*a* and 35*b*, and 27*a* and 27*b* each having two poles are arranged at a position 41 in vertical and horizontal directions, respectively, so as to be symmetrical about the tube axis (Z axis) of the deflection unit 9 with different polarities being opposed each other. A pair of second bipolar permanent magnets 29*a* and 29*b* are arranged at a position 40 opposite to and separated from the pair of upper and lower bipolar permanent magnets 35*a* and 35*b* of the first bipolar permanent magnets toward the electron gun assembly along the Y axis with a predetermined interval therebetween so that different polarities are opposed each other between the magnets 29*a* and 29*b* and the magnets 35*a* and 35*b*, respectively. When the pairs of upper and lower, and left and right first bipolar permanent magnets 35*a* and 35*b*, and 27*a* and 27*b* are arranged at the electron gun side end portion 26 with different polarities being opposed each other. The bipolar permanent magnets 35*a*, 35*b*, 27*a*, and 27*b* generate intense pin-cushion type magnetic fields 31 and 33, as shown in FIG. 20, projecting into the tube axis, i.e., the path of the three electron beams in a space at the position 41. As a result, a spot of an electron beam which reaches the phosphor screen through the pin-cushion type magnetic field 31 generated by the upper and lower bipolar permanent magnets is affected by a Lorentz force in a direction opposite to that of a Lorentz force applied by the barrel type magnetic field 30 and is distorted into an ellipse having its major axis in the vertical direction. The permanent magnets 27*a* and 27*b* generate magnetic fields 34 between the adjacent permanent magnets 35*a* and 35*b*, respectively in a space in the tube axis direction. These magnetic fields apply a Lorentz force on the side beams B and R in a direction opposite to the direction along which spots of the side beams are inclined by the barrel type vertical deflection magnetic field, thereby correcting a phenomenon in which a beam spot is distorted into an ellipse having its major axis in the horizontal direction by the barrel type vertical deflection magnetic field 30 and the pair of side beams are inclined.

An effect of the pin-cushion type magnetic fields 31 and 33 generated by the first permanent magnets 27*a*, 27*b*, 35*a*, and 35*b* on a beam spot formed at the center of the phosphor screen will be described below. The first upper and lower permanent magnets 35*a* and 35*b* described above with reference to FIG. 11 generate a pin-cushion magnetic field similarly to the second upper and lower permanent magnets 29*a* and 29*b*. This pin-cushion magnetic field applies, to an electron beam, a Lorentz force for distorting a beam spot into an ellipse having its major axis in the vertical direction on the screen. However, the pin cushion magnetic field generated by the first left and right permanent magnets 27*a* and 27*b* applies, to an electron beam, a Lorentz force for distorting a beam spot into an ellipse having its major axis in the horizontal direction on the screen. Therefore, by properly setting the magnetization intensities of the upper and lower magnets 35*a* and 35*b* and the left and right magnets 27*a* and 27*b*, beam spots of the three electron beams can be formed into substantially true circles at the central region of the phosphor screen. As described above with reference to FIG. 13, however, in a tube having an in-line type electron gun assembly in which a center beam and a pair of side beams are aligned in a line on the same plane, the magnitudes of Lorentz forces applied from the two pin-cushion magnetic fields 31 and 33 are different between the center beam and the side beams. As a result, if the magnetization intensities of the magnets 35*a*, 35*b*, 27*a*, and 27*b* are set such that beam spots of the side beams are formed into true circles as shown in FIG. 13, a beam spot of the center beam is distorted into an ellipse having its major axis in the vertical direction. Such a longitudinal elliptic shape of the beam spot degrades the resolution at the central portion of the phosphor screen, thereby undesirably degrading focusing quality of the color cathode ray tube.

An effect of the second bipolar permanent magnets 29*a* and 29*b* will be described below. As described above with reference to FIG. 11, the second bipolar permanent magnets 29*a* and 29*b* are separated from the upper and lower bipolar permanent magnets 35*a* and 35*b* of the first set of bipolar permanent magnets toward the electron gun assembly with a predetermined interval therebetween such that different polarities oppose each other between the two pairs of permanent magnets. Therefore, the polarity of a pin-cushion magnetic field generated by the magnets 29*a* and 29*b* is opposite to that of the pin-cushion magnetic field 31 generated by the magnets 35*a* and 35*b*. That is, the direction of a Lorentz force applied to electron beams by the pin-cushion magnetic field generated by the magnets 29*a* and 29*b* is opposite to that of a Lorentz force applied by the pin-cushion magnetic field 31 generated by the magnets 35*a* and 35*b*, and a beam spot is distorted into an ellipse having its major axis in the horizontal direction. Therefore, by setting the magnetization intensity of the magnets 29*a* and 29*b* to be smaller than that of the magnets 35*a* and 35*b*, a beam spot of the center beam can be corrected into a true circle without distortion in beam spots of the pair of side beams separated from the tube axis as shown in FIG. 16. As shown in FIG. 14, an electron beam is emitted from the electron gun assembly 20 and incident at the center of the phosphor screen 5 while it is slightly diverged. Therefore, the electron beam diameter 41 obtained in an area to which the pin-cushion magnetic field generated by the magnets 35*a* and 35*b* is applied, is larger than the electron beam diameter 40 obtained in an area to which the pin-cushion magnetic field generated by the magnets 29*a* and 29*b* is applied. In addition, the intensity of the pin-cushion magnetic field generated by the magnets 35*a* and 35*b* is larger than that of the magnetic field generated by the magnets 29*a* and 29*b*. Therefore, the magnets 29*a* and 29*b* only correct the beam spot of the center beam into a true circle but do not interfere with an effect of the pin-cushion magnetic field generated by the magnets 35*a* and 35*b* for correcting distortion of beam spots and inclination of side beams at the vertical axis end of the phosphor screen.

Figure 21:
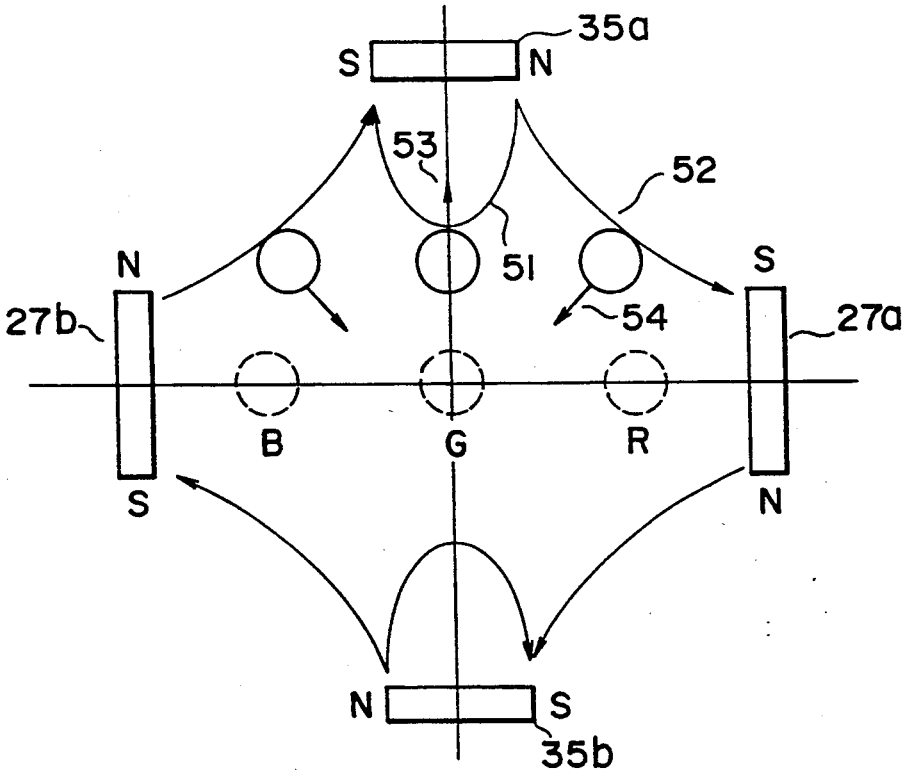

As shown in FIG. 21, the first permanent magnets 35*b*, 27*a*, and 27*b* have an effect on the three electron beams. That is, a magnetic field 51 generated by the upper and lower permanent magnets 35*a* and 35*b* applies a Lorentz force 53 to the center beam G upon vertical deflection, thereby deflecting the center beam G outwardly. A magnetic field 52 applies a Lorentz force 54 to the side beams B and R, thereby returning the electron beams toward the center. For this reason, although coma aberration in convergence is corrected by a magnetic member arranged in an electron gun assembly and coupled to a magnetic field at a rear portion of a deflection unit in a conventional structure, this coma aberration can be corrected by the first permanent magnets 35*a*, 35*b*, 27*a*, and 27*b*. Also in this case, however, if the magnetization intensities of the magnets 35*a*, 35*b*, 27*a*, and 27*b* are set such that beam spots of the pair of side beams are formed into true circles and coma aberration in convergence is corrected, a beam spot of the center beam is distorted into an ellipse having its major axis in the vertical direction. Therefore, by correcting the beam spot of the center beam by the second permanent magnets 29*a* and 29*b*, good focusing characteristics can be obtained, and coma aberration in convergence can be corrected. As compared with a magnetic field area of the first permanent magnets 35*a*, 35*b*, 27*a*, and 27*b*, a vertical magnetic field is small and hardly deflected in a magnetic field of the second permanent magnets. Therefore, the second permanent magnets have almost no influence on coma aberration in convergence.

Embodiment 4

Figure 22:
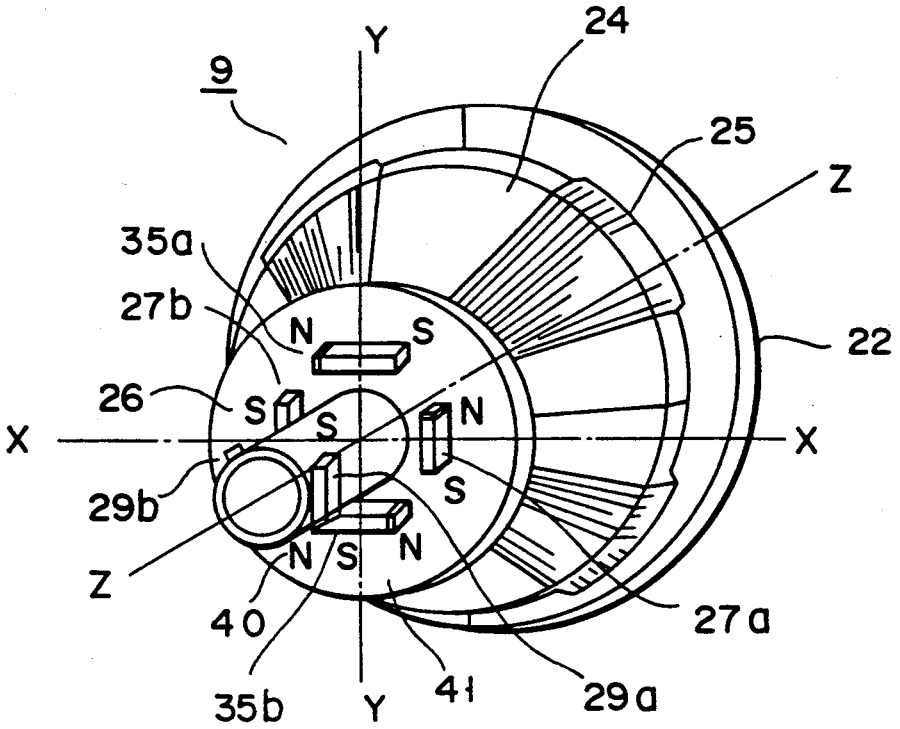
FIG. 22 is a perspective view showing a detection unit to be mounted on a color cathode ray tube according to the fourth embodiment of the present invention and two pairs of permanent magnets mounted on the deflection unit.
Figure 23:
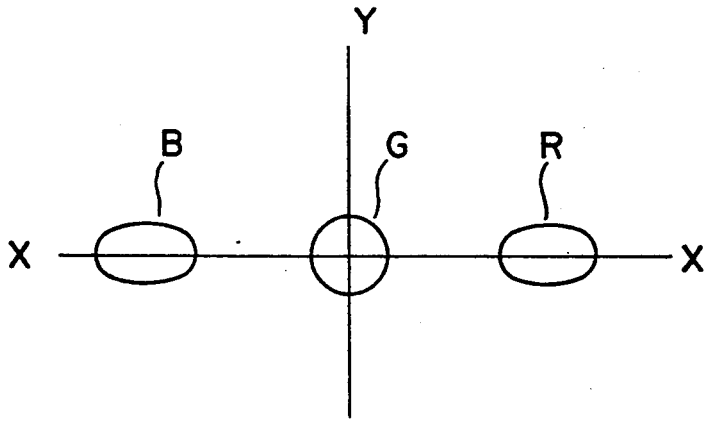
FIG. 23 is a view showing shapes of electron beam spots for explaining a effect of the permanent magnets shown in FIG. 22.

In above Embodiment 3, the second bipolar permanent magnets for correcting distortion in a beam spot of an electron beam at the center of the phosphor screen are arranged to oppose the pair of upper and lower bipolar permanent magnets of the two pairs of upper and lower, and left and right bipolar permanent magnets arranged at the side end portion of the electron gun assembly side of the deflection unit and are separated therefrom toward the electron gun assembly with a predetermined interval therebetween. As shown in FIG. 22, the second bipolar permanent magnets can be arranged to oppose the pair of bipolar permanent magnets 27*a* and 27*b* in the horizontal direction of the first bipolar permanent magnets and separated therefrom toward the electron gun assembly with a predetermined interval therebetween. In this case, the magnitudes of magnetization intensities of the magnets 35*a*, 35*b*, 27*a*, and 27*b* are preferably set such that a beam spot of a center beam is formed into a substantially true circle and that of each of a pair of side beams is distorted into an ellipse having its major axis in the horizontal direction by pin-cushion magnetic fields generated by the magnets. Also in this case, a pin-cushion magnetic field generated by the second bipolar permanent magnets 29*a* and 29*b* only corrects the shape of the beam spot of each side beam into a true circle but does not interfere with an effect of a pin-cushion magnetic field generated by the upper and lower bipolar permanent magnets 35*a* and 35*b* for correcting distortion in beam spot at the vertical axis end of the phosphor screen and for correcting coma aberration of the convergence.

Embodiment 5

Figure 24:
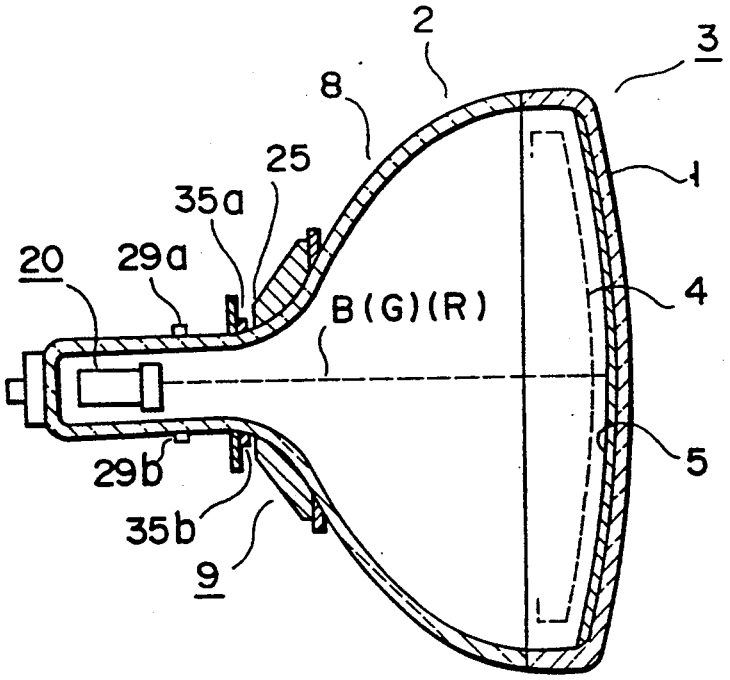
FIGS. 24 and 25 are schematic sectional views showing color cathode ray tubes according to the fifth and sixth embodiments of the present invention.

In Embodiments 3 and 4, the first bipolar permanent magnets are arranged at the end portion of the electron gun assembly side of the deflection unit. The present invention, however, is not limited to this arrangement. For example, as shown in FIG. 24, first permanent magnets may be arranged at a portion 26 close to a core 23 of a deflection unit 9. In this case, first bipolar permanent magnets 35 and 27 are located in an area in which the diameter of an electron beams is large because the beam is diverged. Therefore, an effect of correcting distortion in beam spot at the vertical axis end of the phosphor screen can be further enhanced.

Embodiment 6

Figure 25:
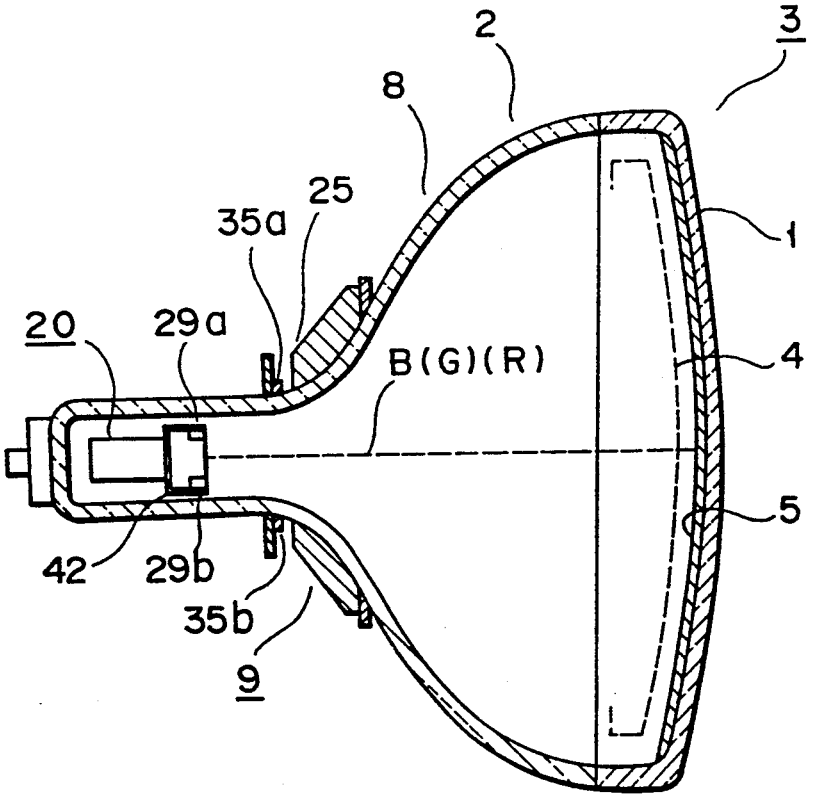

In above Embodiments 3, 4, and 5, the second bipolar magnets for correcting distortion in electron beam at the center of the phosphor screen are separated from the first bipolar permanent magnets toward the electron gun of the deflection unit by a predetermined interval therebetween. The present invention, however, is not limited to this arrangement. For example, as shown in FIG. 25, these magnets may be arranged inside a convergence cup 42 at the distal end portion of an electron gun assembly 20. In this case, since an interval with respect to first bipolar permanent magnets arranged in a deflection unit 9 can be further increased, distortion in electron beam spot at the center of a phosphor screen can be corrected better.

As has been described above, according to the present invention, a pair of left and right permanent magnets are arranged at the end portion of the electron gun assembly side of the deflection unit for generating a deflection magnetic field for deflecting three electron beams aligned in a line passing through the same plane, in the beam aligning direction of the beams and a direction perpendicular to the beam aligning direction, and a pair of upper and lower permanent magnets for generating a pin-cushion magnetic field are arranged to be separated from the end portion of the electron gun assembly side toward the electron gun assembly by a predetermined interval. Therefore, distortion in electron beam spot caused by a barrel magnetic field generated by a vertical deflection coil can be corrected by the pin-cushion magnetic fields generated by the two pairs of permanent magnets, thereby improving focusing performance at the vertical axis end portion of the phosphor screen. In addition, differences between beam spots of the three electron beams at the central portion of the phosphor screen can be corrected to prevent degradation in focusing performance at the central portion of the phosphor screen. As a result, there is provided a color cathode ray tube having high focusing performance, high resolution, and high performance.

In addition, according to the present invention, pairs of upper and lower, and left and right bipolar permanent magnets are arranged at the end portion of the electron gun assembly side of the deflection unit for generating a deflection magnetic field for deflecting three electron beams aligned in a line passing through the same plane, in the beam aligning direction of the beams and a direction perpendicular to the beam aligning direction, and a pair of bipolar permanent magnets for generating a pin-cushion magnetic field are arranged to be separated from the side end portion of the electron gun assembly toward the electron gun assembly. Therefore, distortion in electron beam spot caused by a barrel type magnetic field generated by a vertical deflection coil can be corrected by the pin-cushion magnetic fields generated by the three pairs of bipolar permanent magnets, thereby improving focusing performance at the vertical axis end portion of the phosphor screen. In addition, differences between beam spots of the three electron beams at the central portion of the phosphor screen can be connected to improve focusing performance at the central portion of the phosphor screen. As a result, there is provided a color cathode ray tube having high focusing performance, high resolution, and high performance.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A cathode ray tube apparatus, comprising:

an envelope having a tube axis extending in an axial direction;

an in-line type electron gun assembly, received in said envelope, for emitting a center electron beam and two side beams in the same plane;

deflection magnetic field generating means for generating a mainly pin-cushion type deflection magnetic field for deflecting the electron beams in a first direction along the plane and generating a mainly barrel type deflection magnetic field for deflecting the electron beams in a second direction perpendicular to the first direction;

a first pair of permanent magnet pieces, each having one and opposite poles, located on an electron gun assembly side of said deflection magnetic filed generating means, arranged in the first direction so as to be substantially symmetrical about the tube axis, and faced to each other in such a manner that different polarities are opposed to each other, for constantly generating a pin-cushion type first correction magnetic field; and a second pair of permanent magnet pieces, each having one and opposite poles, located on the electron gun assembly side of said deflection magnetic field generating means and separated in the axial direction from said first pair of permanent magnetic pieces towards said electron gun assembly, arranged in the second direction so as to be substantially symmetrical about the tube axis, and faced to each other in such a manner that different polarities are opposed each other, for constantly generating a pin-cushion type second correction magnetic field.

2. An apparatus according to claim 1, wherein said first and second pairs of permanent magnet pieces are arranged outside said envelope.

3. An apparatus according to claim 1, wherein said second pair of permanent magnet pieces are arranged in said electron gun assembly.

4. A cathode ray tube apparatus comprising:

an envelope having a tube axis extending in an axial direction;

an in-line type electron gun assembly, received in said envelope, for emitting a center electron beam and two side beams in the same plane;

deflection magnetic field generating means for generating a mainly pin-cushion type deflection magnetic field for deflecting the electron beams in a first direction along the plane and generating a mainly barrel type deflection magnetic field for deflecting the electron beams in a second direction perpendicular to the first direction;

a first and second pair of permanent magnet pieces, each having one and opposite poles, located on an electron gun assembly side of said deflection magnetic field generating means, said first and second pair of permanent magnetic pieces arranged in the first and second direction, respectively, so as to be substantially symmetrical about the tube axis, each pair being faced to each other in such a manner that different polarities are opposed to each other, for constantly generating a pin-cushion type first correction magnetic field; and a third pair of permanent magnet pieces, having one and opposite poles, located on the electron gun assembly side of said deflection magnetic field generating means and separated in the axial direction from said first and second pairs of permanent magnet pieces towards said electron gun assembly, arranged in one of the first and second directions so as to be substantially symmetrical about the tube axis, and faced to each other in such a manner that different polarities are opposed to a facing one of the first and second pairs of permanent magnet pieces, for constantly generating a pin-cushion type second correction magnetic field.

5. An apparatus according to claim 4, wherein said first, second and third pairs of permanent magnet pieces are arranged outside said envelope.

6. An apparatus according to claim 4, wherein said third pair of permanent magnet pieces are arranged in said electron gun assembly.

* * * * *